US006032371A

United States Patent [19]

Chou

[11] Patent Number: 6,032,371

[45] Date of Patent: Mar. 7, 2000

[54] SAFETY CUTTING DEVICE

[75] Inventor: Shu Hui Chou, Taipei Hsien, Taiwan

[73] Assignee: Welcome Company Ltd., Taiwan

[21] Appl. No.: 09/141,167

[22] Filed: Aug. 27, 1998

[30] Foreign Application Priority Data

Mar. 4, 1998 [TW] Taiwan ..... 87203139

[51] Int. Cl.[7] ..... B26B 3/00

[52] U.S. Cl. ..... 30/294; 30/280; 30/123

[58] Field of Search ..... 30/294, 280, 278, 30/140, 123

[56] References Cited

U.S. PATENT DOCUMENTS

| | | | |
|---|---|---|---|
| 2,254,199 | 9/1941 | Baltuch | 30/289 |
| 2,688,187 | 9/1954 | Pauli | 30/289 |
| 3,028,670 | 4/1962 | Tilly | 30/294 |
| 4,524,516 | 6/1985 | Wiechard | 30/290 |
| 5,046,253 | 9/1991 | Ireland | 30/294 |
| 5,524,348 | 6/1996 | Tipp | 30/294 |
| 5,561,905 | 10/1996 | Sherman | 30/280 |
| 5,590,471 | 1/1997 | Wiezenthal | 30/294 |
| 5,724,738 | 3/1998 | Ballarini | 30/294 |

FOREIGN PATENT DOCUMENTS

| | | | |
|---|---|---|---|
| 040687 | 4/1988 | Taiwan . | |
| 75203282 | 7/1988 | Taiwan . | |
| 603942 | 6/1948 | United Kingdom | 30/294 |

*Primary Examiner*—Hwei-Siu Payer
*Attorney, Agent, or Firm*—Jeffer, Mangels, Butler & Marmaro LLP

[57] ABSTRACT

A cutting device includes a cutting blade having a cutting edge, and a shell holding the cutting blade on the inside thereof. The shell has an outer edge, and has defined therein a chamber that encompasses at least a portion of the cutting edge of the cutting blade, as well as an insertion slot extending from the chamber to the outer edge of the shell.

14 Claims, 3 Drawing Sheets

SAFETY CUTTING DEVICE

FIELD OF THE INVENTION

The present invention relates to cutting means, and more particularly to a safety cutting device for cutting paper, plastic sheet materials, paper bags, plastic bags, etc.

BACKGROUND OF THE INVENTION

When cutting paper, plastic sheet materials, paper bags, plastic bags, etc., a safety cutting device may be used. A regular safety cutting device is generally comprised of a cutting blade, and a plastic shell covering on the cutting blade. The plastic shell has a narrow slot of width about within 0.1 cm to 0.9 cm into which soft thin material is inserted and cut by the cutting edge of the cutting blade. Because the slot does not allow the finger to pass, the safety cutting device is safe to use. However, because the insertion slot perpendicularly extends from the cutting edge of the cutting blade, the cutting effect of the safety cutting device is not satisfactory when cutting a soft, resilient material. Furthermore, because the plastic shell includes two symmetrical shells fastened together to hold the cutting blade therebetween, the manufacturing cost of this type of safety cutting device is high.

SUMMARY OF THE PREFERRED EMBODIMENTS

In accordance with one aspect of the present invention, there is provided a safety cutting device including a cutting blade having a cutting edge at one peripheral side thereof, and a plastic shell molded on the cutting blade and holding the cutting blade on the inside thereof. The plastic shell has defined therein a chamber around at least a portion of the cutting edge of the cutting blade, and has an outer edge and an insertion slot extending from the chamber to the outer edge of the plastic shell.

In a preferred embodiment the insertion slot forms an acute angle with the cutting edge of the cutting blade.

In another preferred embodiment the insertion slot has a width ranging from about 0.1 cm to about 0.9 cm.

According to another aspect of the present invention, there is provided a safety cutting device comprising a cutting blade having a cutting edge and a plastic shell at least partially surrounding the cutting blade. The plastic shell has defined therein a chamber into which at least a portion of the cutting edge of the cutting blade extends, and an insertion slot extending from the chamber to the outside of the plastic shell.

In a preferred embodiment of the present invention the safety cutting device is combined with an electric heat sealer.

Other objects, features and advantages of the present invention will become apparent to those skilled in the art from the following detailed description. It is to be understood, however, that the detailed description and specific examples, while indicating preferred embodiments of the present invention, are given by way of illustration and not limitation. Many changes and modifications within the scope of the present invention may be made without departing from the spirit thereof, and the invention includes all such modifications.

BRIEF DESCRIPTION OF THE DRAWINGS

The invention may be more readily understood by referring to the accompanying drawings in which.

Like numerals refer to like parts throughout the several views of the drawings.

DETAILED DESCRIPTION OF THE PREFERRED EMBODIMENTS

Figure 1:
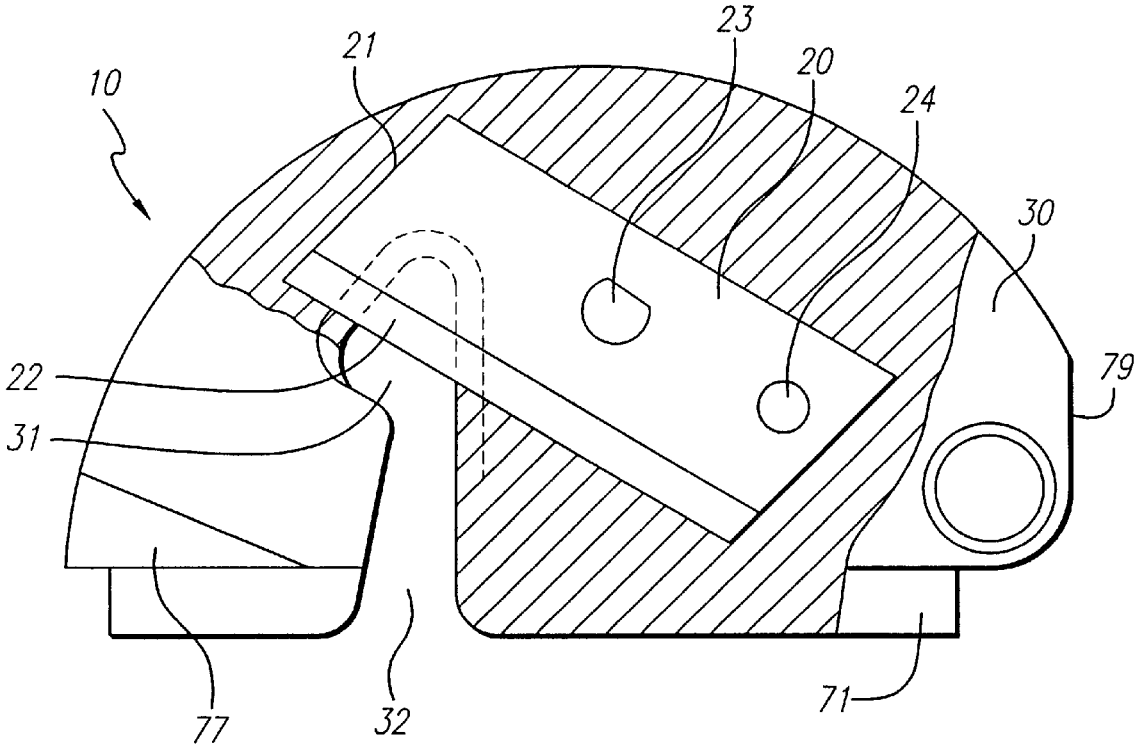
FIG. 1 is a plan view of an embodiment of a safety cutting device according to the present invention.
Figure 2:
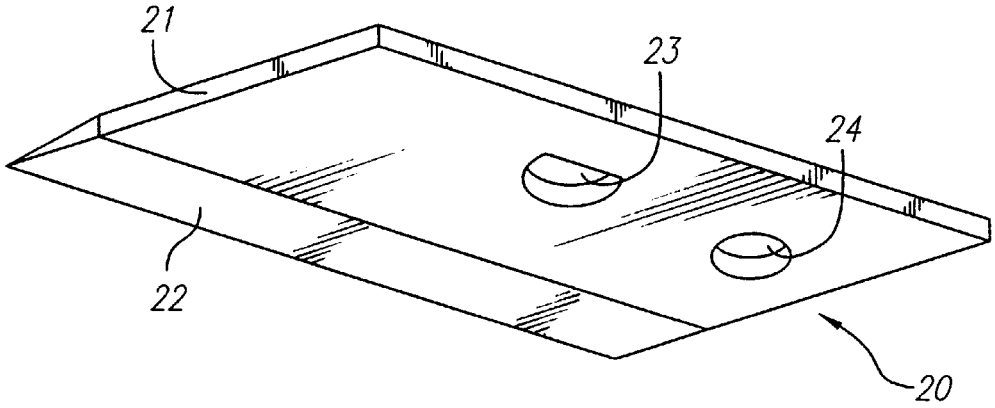
FIG. 2 is a partial sectional elevational view of the cutting blade of the safety cutting device of FIG. 1.

Referring to FIGS. 1 and 2, an embodiment of a safety cutting device 10 includes a cutting blade 20 and a shell, preferably a plastic shell 30, as shown. The cutting blade 20 preferably is a flat, rectangular blade having a cutting edge 22 at one of the peripheral sides 21 thereof. The plastic shell 30 is molded on said cutting blade 20 and holds said cutting blade 20 on the inside thereof. The plastic shell 30 can be molded on the cutting blade 20 by a conventional method such as injection molding or the like. Alternatively, plastic shell 30 can be formed from two or more pieces and cutting blade 20 can be secured between the several pieces.

A chamber 31 is defined inside the plastic shell 30 thereby exposing at least a portion of the cutting edge 22 of the cutting blade 20. At least one insertion slot 32 extends from the chamber 31 to the outer edge of the plastic shell 30. The insertion slot 32 as illustrated preferably forms an angle with the cutting edge 22 of the cutting blade 20. The angle may be acute, obtuse or right, depending on the configuration of cutting blade 30. The insertion slot 32 has an inner edge curving from the chamber 31, and has a width gradually increasing from the chamber 31 toward the outer edge of the plastic shell so that an object to be cut can be conveniently inserted into the insertion slot 32 and cut by the cutting edge 22 of the cutting blade 20.

The cutting blade 20 preferably has defined therein at least one locating hole, for example, as shown in FIGS. 1 and 2, at least one large locating hole 23 and at least one small locating hole 24. The locating holes 23 and 24 are each preferably formed in a different shape. The plastic shell 30 has defined therein through holes corresponding to the locating holes 23 and 24 on the cutting blade 20.

The cutting blade 20 is used for cutting paper, plastic sheet material, paper bags and the like. Because the insertion slot 32 has an inner edge curving from the chamber 31, an object to be cut that is inserted into the insertion slot 32 can be easily directed into cutting engagement with the cutting edge 22 of the cutting blade 20, and thereby cut.

Figure 3:
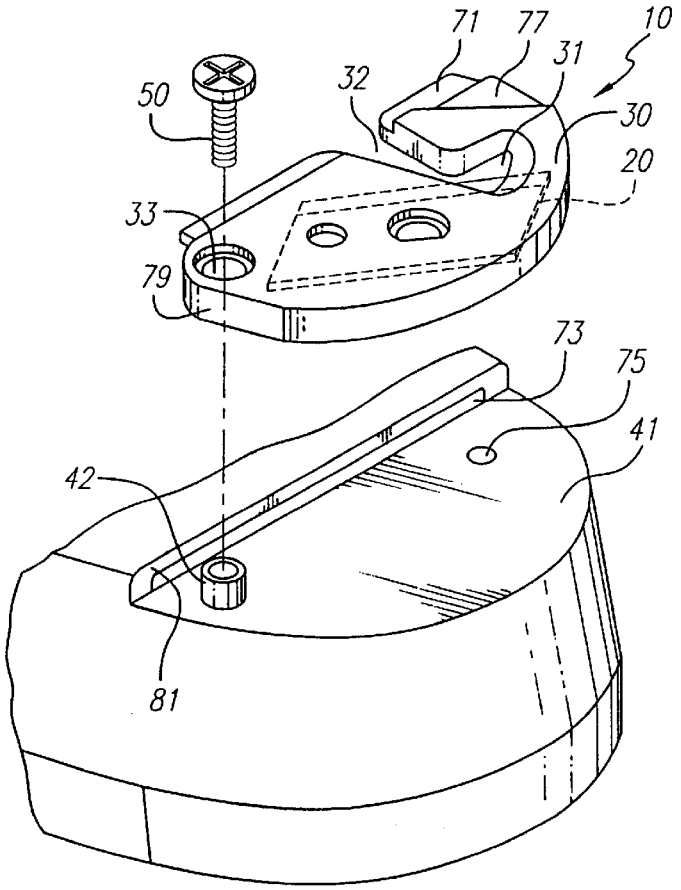
FIG. 3 is an exploded perspective view showing the installation of the safety cutting device of FIG. 1 on an electric heat sealer.
Figure 4:
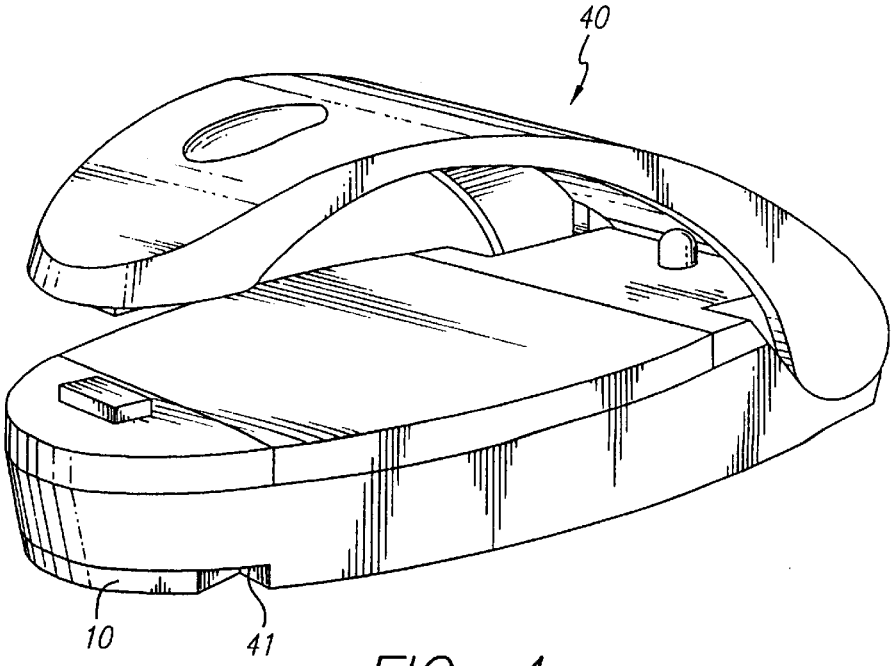
FIG. 4 is a perspective view showing the safety cutting device of FIG. 1 received in a recessed portion of an electric heat sealer according to the present invention.
Figure 5:
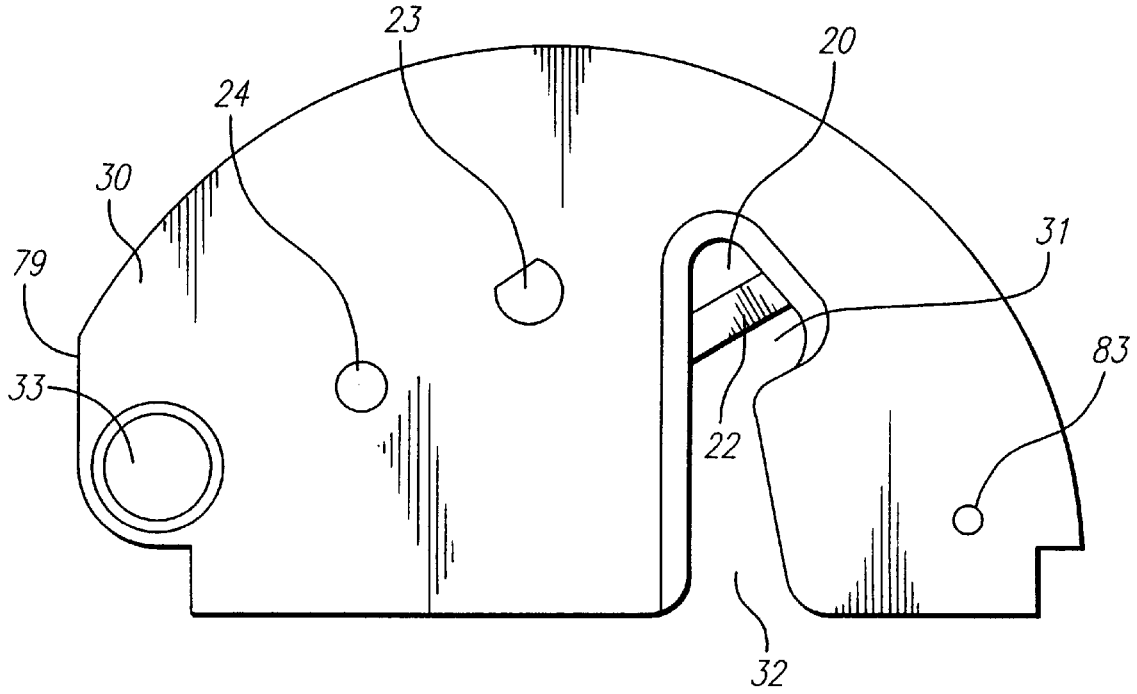
FIG. 5 is an elevational view showing the opposite side of the safety cutting device shown in FIG. 1.

Referring to FIGS. 3–5, a pivot hole 33 is preferably defined in one corner of the safety cutting device 10 so that the safety cutting device 10 can be pivotally engaged to an axle 42 extending from a recessed portion 41 of the bottom side of an article, for example, a device including a heating element such as an electric heat sealer 40 for sealing plastic bags. The safety cutting device 10 is secured in place by a screw 50 or the like that extends through the pivot hole 33 and threadedly engages the axle 42.

When not in use, the safety cutting device 10 is preferably received by the recessed portion 41 of the electric heat sealer 40, and is flush with the periphery of the electric heat sealer 40 (see FIG. 4). The plastic shell 30 of the safety cutting device 10 preferably has at least one flange 71 that extends therefrom as shown in FIG. 3. The electric heat sealer 40 preferably includes a groove 73 adapted to receive the flange 71 of the safety cutting device 10, thereby preferably establishing a friction fit between the flange 71 and the portion of the electric heat sealer 40 that surrounds the groove 73. The recessed portion 41 also preferably includes a dimple 75 adapted to receive a knob 83 that is preferably located on a corresponding portion of the safety cutting device 10, as shown in FIG. 5. When the safety cutting device 10 is received by the recessed portion 41 the dimple 75 receives the knob 83, thereby holding the safety cutting device in the desired position. Alternatively the safety cutting device 10 can be pivotally connected to other devices or articles.

The safety cutting device 10 preferably includes a notch 77, remote from the pivot hole 33 as shown in FIG. 3. When using the safety cutting device 10 the user places a fingernail or the like in the notch 77 and rotates the device 10 about the axle 42.

The periphery of safety cutting device 10 preferably includes a flat section 79 adjacent said pivot hole 33. The flat section 79 prevents the safety cutting device 10 from being rotated about the axle 42 more than approximately 90°. When the safety cutting device is rotated about the axle 42 approximately 90°, the flat section 79 comes into contact with an edge 81 of the electric heat sealer 40, thereby stopping the rotation of the device 10.

It will be understood that various modifications and changes can be made to the foregoing particular embodiments without departing from the spirit and scope of the invention disclosed. In particular, the inventive safety cutting device can be affixed to articles other than the specific hand-held heat sealer described herein, for example hand-held devices such as staplers and staple removers, as well as typically non-hand-held devices such as tape dispensers, table-mounted heat sealers, and other household utility items, and at locations on such articles other than a forward recess as described herein.

What is claimed is:

1. An article of manufacture comprising a) an electric heat sealer and b) a safety cutting device connected to said electric heat sealer, said safety cutting device comprising (i) a cutting blade having a cutting edge, and (ii) a plastic shell having an outer edge and at least partially surrounding said cutting blade, said plastic shell having defined therein a chamber into which at least a portion of said cutting edge of said cutting blade extends, and an insertion slot extending at an angle from said chamber to said outer edge of said plastic shell.

2. The article of manufacture of claim 1, wherein said electric heat sealer comprises an axle, and said safety cutting device comprises a pivot hole, and wherein said pivot hole of said safety cutting device pivotally engages said axle.

3. The article of manufacture of claim 1, wherein said electric heat sealer has defined therein a recessed portion, said recessed portion having defined therein a groove, and said plastic shell of said safety cutting device comprises a flange extending from said outer edge thereof, wherein said safety cutting device is received within said recessed portion of said electric heat sealer and said flange of said safety cutting device engages said groove.

4. An article of manufacture comprising a) an electric heat sealer and b) a safety cutting device connected to said electric heat sealer, said safety cutting device comprising i) a cutting blade having a cutting edge, and ii) a shell holding said cutting blade on the inside thereof, said shell having an outer edge, said shell having defined therein a chamber that encompasses at least a portion of said cutting edge of said cutting blade and an insertion slot extending from said chamber to said outer edge of said shell.

5. The article of claim 4 wherein said electric heat sealer has defined therein a recessed portion and wherein said safety cutting device is received within said recessed portion of said electric heat sealer.

6. The article of claim 5 wherein said recessed portion of said electric heat sealer has a peripheral edge and wherein said outer edge of said shell of said safety cutting device conforms to said peripheral edge.

7. The article of claim 5 wherein said recessed portion of said electric heat sealer includes a dimple adapted to receive a knob of said safety cutting device.

8. An article of manufacture comprising a) a hand-held device, and b) a safety cutting device connected to said hand-held device, said safety cutting device comprising (i) a cutting blade having a cutting edge, and (ii) a shell holding said cutting blade on the inside thereof, said shell having an outer edge, said shell having defined therein a chamber that encompasses at least a portion of cutting edge of said cutting blade and an insertion slot extending from said chamber to said outer edge of said shell.

9. The article of claim 8 wherein said hand-held device is an apparatus including a heating element.

10. A safety cutting device comprising (a) a cutting blade having a cutting edge, and (b) a plastic shell having an outer edge and at least partially surrounding said cutting blade, said plastic shell having defined therein a chamber into which at least a portion of said cutting edge of said cutting blade extends, an insertion slot extending at an angle from said chamber to said outer edge of plastic shell, and a flange extending from said outer edge thereof.

11. The safety cutting device of claim 10 further comprising a pivot hole.

12. The safety cutting device of claim 10 further comprising a knob.

13. The safety cutting device of claim 10 wherein said plastic shell further comprises an upper surface in which is defined a notch.

14. A safety cutting device comprising (a) a cutting blade having a cutting edge, and (b) a plastic shell having an outer edge and at least partially surrounding said cutting blade, said plastic shell having defined therein a chamber into which at least a portion of said cutting edge of said cutting blade extends, an insertion slot extending at an angle from said chamber to said outer edge of said plastic shell, and a knob on an outer surface thereof.

* * * * *